US009863192B2

(12) United States Patent
Wiedemann

(10) Patent No.: US 9,863,192 B2
(45) Date of Patent: Jan. 9, 2018

(54) SLIP INSERT WITH INTERRUPTED THREAD PROFILE

(71) Applicant: FORUM US, INC, Houston, TX (US)

(72) Inventor: Jim Wiedemann, Edmonton (CA)

(73) Assignee: FORUM US, INC., Houston, TX (US)

( * ) Notice: Subject to any disclaimer, the term of this patent is extended or adjusted under 35 U.S.C. 154(b) by 201 days.

(21) Appl. No.: 14/873,977

(22) Filed: Oct. 2, 2015

(65) Prior Publication Data

US 2017/0096865 A1 Apr. 6, 2017

(51) Int. Cl.
*E21B 19/10* (2006.01)
*E21B 33/04* (2006.01)

(52) U.S. Cl.
CPC ..... *E21B 19/10* (2013.01); *E21B 33/0422* (2013.01)

(58) Field of Classification Search
USPC ..... 166/75.14; 294/102.2
See application file for complete search history.

(56) References Cited

U.S. PATENT DOCUMENTS 1,641,467 A * 9/1927 Adair ..... E21B 19/10 175/423
1,749,946 A * 3/1930 Kaough ..... E21B 19/10 175/423
1,908,421 A * 5/1933 Heggem ..... E21B 19/10 166/217
3,365,762 A * 1/1968 Spiri ..... E21B 19/10 188/67

* cited by examiner

*Primary Examiner* — Kyle Armstrong
(74) *Attorney, Agent, or Firm* — Patterson & Sheridan, LLP

(57) ABSTRACT

A slip insert is disclosed that includes a body having a curved face for receiving a tubular member, a plurality of first threads formed in a first direction on the face, and a plurality of second threads formed in a second direction on a portion of the first threads, the second direction being opposite of the first direction.

19 Claims, 8 Drawing Sheets

SLIP INSERT WITH INTERRUPTED THREAD PROFILE

BACKGROUND

Field

Embodiments of the disclosure generally relate to a slip insert having an interrupted thread profile and methods of using the same.

Description of the Related Art

In the oil and gas production industry, a clamping device having one or more slip inserts is used to grip tubular members, such as threaded pipe or coiled tubing, which are raised and lowered into and out of a wellbore through a wellhead. Typically, opposing slip inserts are forced into engagement with an outer surface of a tubular member to grip and support the tubular member relative to the wellhead. The slip inserts have raised features, such as teeth or gripping inserts, formed on a surface of the slip insert that engage and penetrate the outer surface of the tubular member. The raised features, in combination with the force applied to the slip inserts, are configured to hold the tubular member in place regardless of any loads or other force (e.g. the weight of the tubular member and/or wellbore pressure) acting on the tubular member.

One drawback of conventional slip inserts is that the raised features penetrate into the outer surface of the tubular member, leaving marks or indentations on the outer surface of the tubular member that extend around the circumference the tubular member where the slip inserts make contact. These circumferentially located marks or indentations cause fatigue in the tubular member and become weak points that may lead to failure of the tubular member during use. For example, coil tubing, which is subject to bending stresses during use, may fail at the location of the marks or indentations left by the raised features of the slip inserts. This fatigue decreases the operating lifespan of the tubular member.

Therefore, there exists a need for a new and/or improved slip insert that overcomes the drawbacks associated with conventional slip inserts.

SUMMARY

It is therefore an object of the disclosure to provide a slip insert having an interrupted thread profile and methods of making the same.

In one embodiment, a slip insert is disclosed that includes a body having a curved face for receiving a tubular member, a plurality of first threads formed in a first direction on the face, and a plurality of second threads formed in a second direction on a portion of the first threads, the second direction being opposite of the first direction.

In another embodiment, a slip insert is disclosed that includes a body having a curved face for receiving a tubular member, a plurality of first threads formed in a first direction on the face having a first lead, and a plurality of second threads having a second lead formed in a second direction on a portion of the first threads, the second direction being opposite of the first direction and the second lead is greater than the first lead.

In another embodiment, a clamping device is disclosed that includes housing, and a first slip insert disposed in the housing and a second slip insert disposed in the housing opposing the first slip insert. Each of the slip inserts comprise a body having a curved face for receiving a tubular member, a plurality of first threads formed in a first direction on the face, and a plurality of second threads formed in a second direction on a portion of the first threads, the second direction being opposite of the first direction.

BRIEF DESCRIPTION OF THE DRAWINGS

Having generally described the various embodiments of the disclosure, reference will now be made to the accompanying drawings.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of the disclosure include a slip insert having an interrupted tooth profile and methods of using the same. The slip insert includes a tooth pattern comprising a primary pattern and a secondary pattern that interrupts the primary pattern. The primary and secondary pattern can be machined on the same tool with the same tool setup, which saves time and costs. Embodiments of the slip inserts as described herein may be used with coiled tubing valves (such as blow-out preventers), or any other devices utilized to grip and support tubular members in the petroleum industry.

Figure 1A:
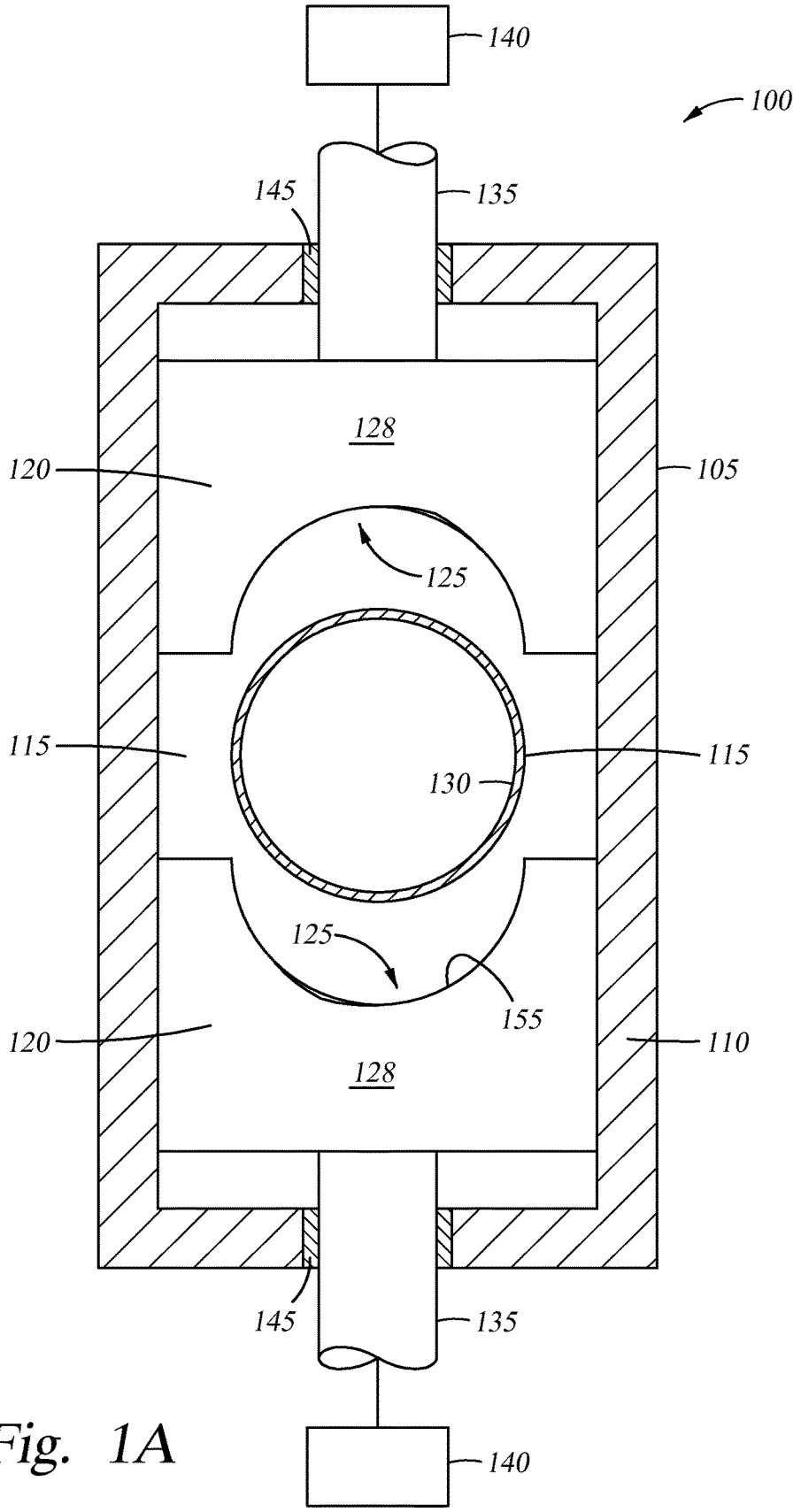
FIG. 1A is a schematic cross-sectional view of a clamping device according to one embodiment.

FIG. 1A is a schematic cross-sectional view of a clamping device 100 having an embodiment of slip inserts as disclosed herein. The clamping device 100 includes a housing 105 that having a sidewall 110 that defines a pressure containment region 115. A pair of opposing slip inserts 120 is disposed in the pressure containment region 115. Each of the slip inserts 120 have a face 125 formed in a body 128. Each face 125 is U-shaped or curved to define a semicircular opening for receiving a portion of a tubular member 130. Each slip inserts 120 may be coupled to a shaft 135. Each shaft 135 is disposed in openings formed in the sidewall 110 and may be coupled to an actuator 140. Each actuator 140 may be a hydraulic device adapted to move the slip inserts 120 toward and away from the tubular member 130. Each shaft 135 may be surrounded by a pressure seal 145 to contain pressures in the pressure containment region 115. Another set of slip inserts (not shown) may be similarly constructed and disposed above or below the slip inserts 120 in the pressure containment region 115. In one embodiment, the clamping device 100 may be a blow-out preventer for use in coiled tubing operations.

Figure 1B:
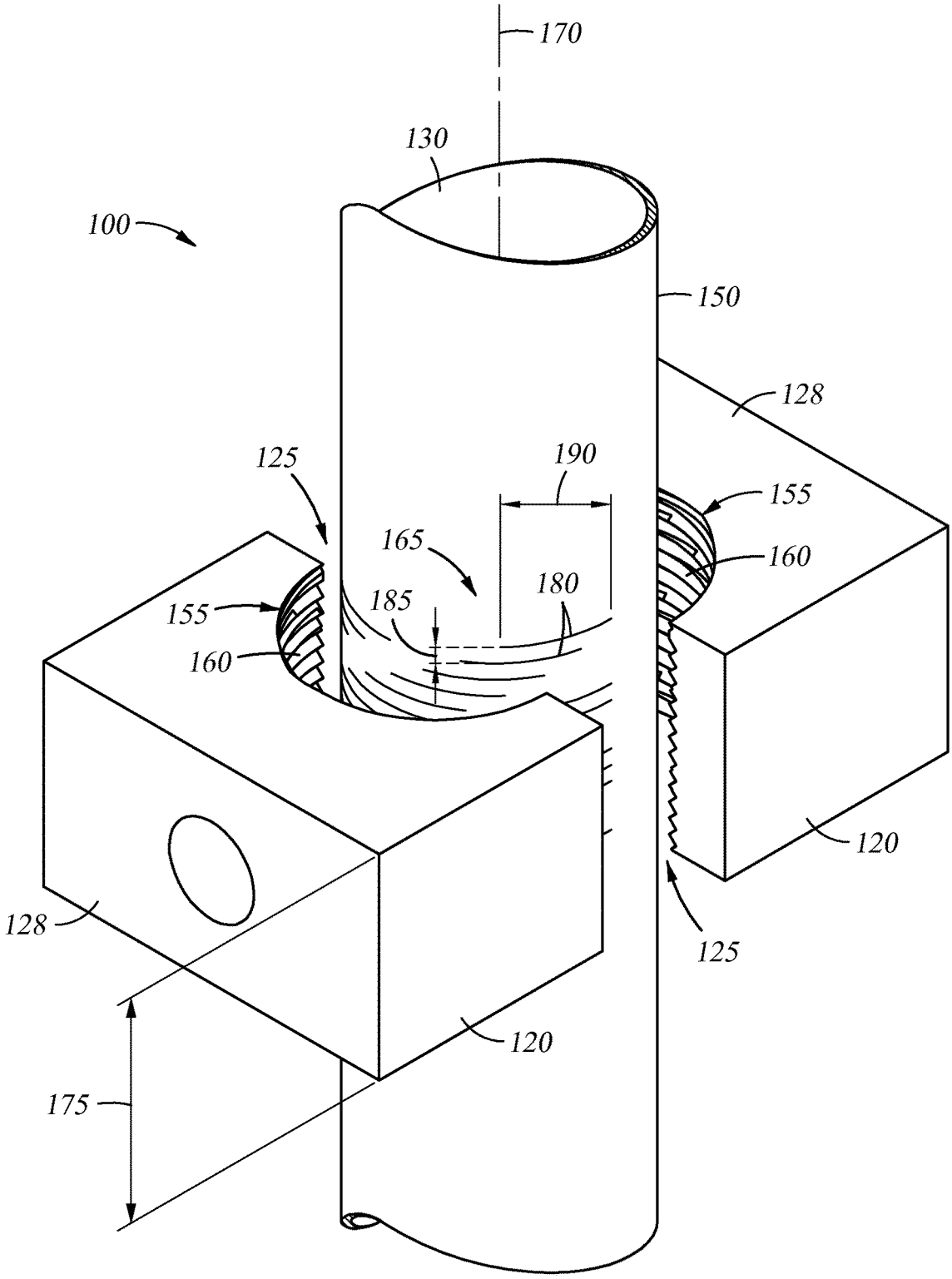
FIG. 1B is an isometric view of a portion of the clamping device of FIG. 1A.

FIG. 154B is an isometric view of a portion of the clamping device 100 of FIG. 1A. The slip inserts 120 are shown in an open position in FIGS. 1A and 1B. When actuated, the slip inserts 120 move toward and into contact with an outer surface 150 of the tubular member 130. The faces 125 of the slip inserts 120 include a profile 155 that includes a plurality of threads 160. When gripping the tubular member 130, at least a portion of the threads 160 penetrate into the outer surface 150 of the tubular member 130 to form a mark pattern 165. The threads 160 of the profile 155 form the mark pattern 165 based on the pattern of the profile 155 (i.e., the number and/or orientation of the threads 160).

The mark pattern 165 of the profile 155 distributes marks 180 across the outer surface 150 of the tubular member 130. The marks 180 are non-continuous and do not extend around the entire circumference of the outer surface 150 of the tubular member 130 where the faces 125 of the slip inserts 120 make contact with the tubular member 130. A lead 185 of the marks 180 along the longitudinal axis 170 of the tubular member 130 may be varied based on the profile 155, which varies along a dimension 175 of the body 128 of the slip inserts 120. Alternatively or additionally, a length 190 of each mark 180 may be varied based on the profile 155. In the embodiment shown, the length 190 of the marks 180 are a fraction of the length of the threads 160, and the marks 180 repeat in a diagonal orientation (separated by the lead 185) across the outer surface 150 of the tubular member 130. In some embodiments, the length 190 of each mark 180 may be the same. In other embodiments, the marks 180 may repeat in rows along the longitudinal axis 170 of the tubular member 130 with a non-marked area between the rows.

Figure 2A:
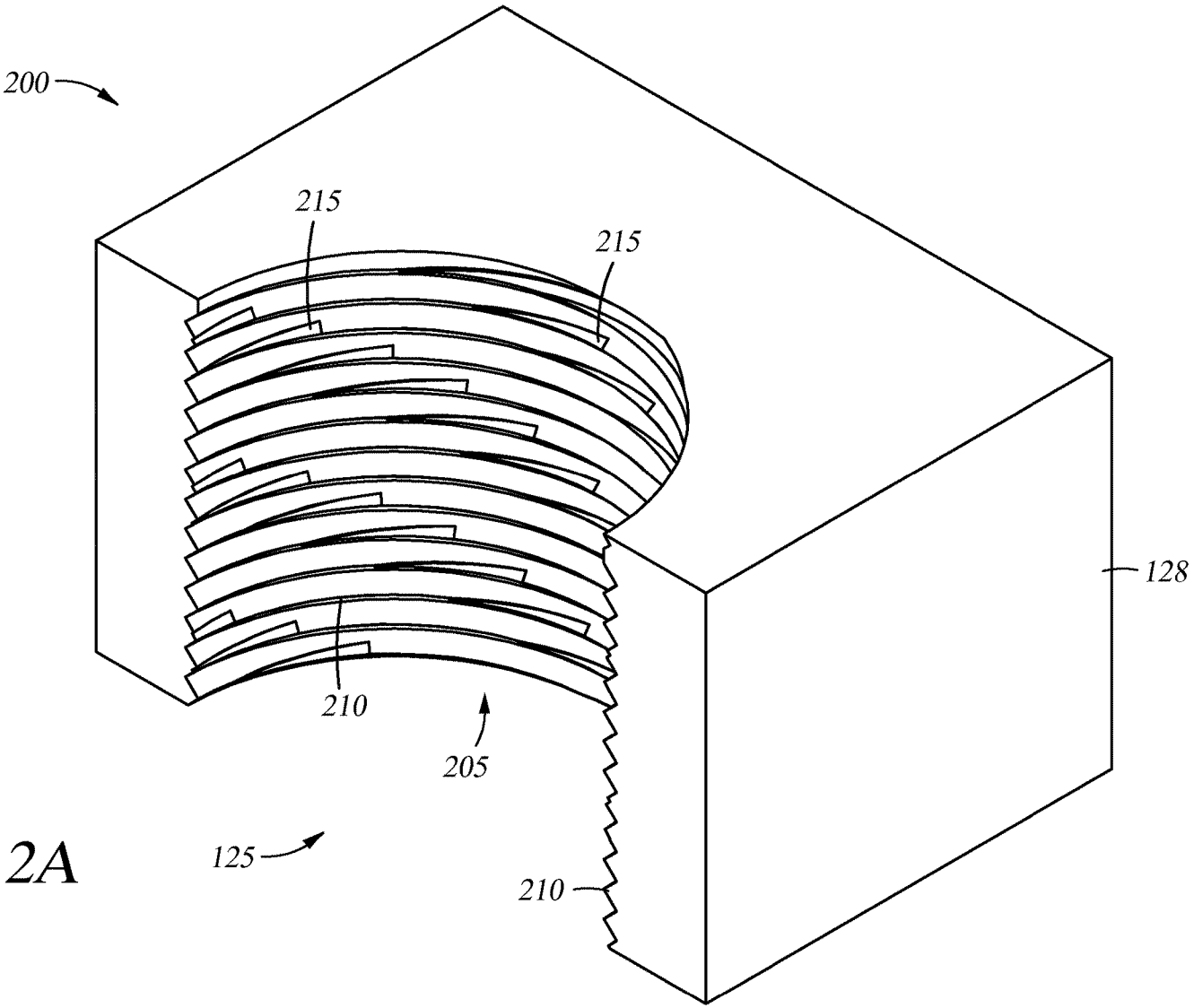
FIG. 2A is an isometric view of one embodiment of a slip insert that may be used as the slip inserts in the clamping device of FIGS. 1A and 1B.
Figure 2B:
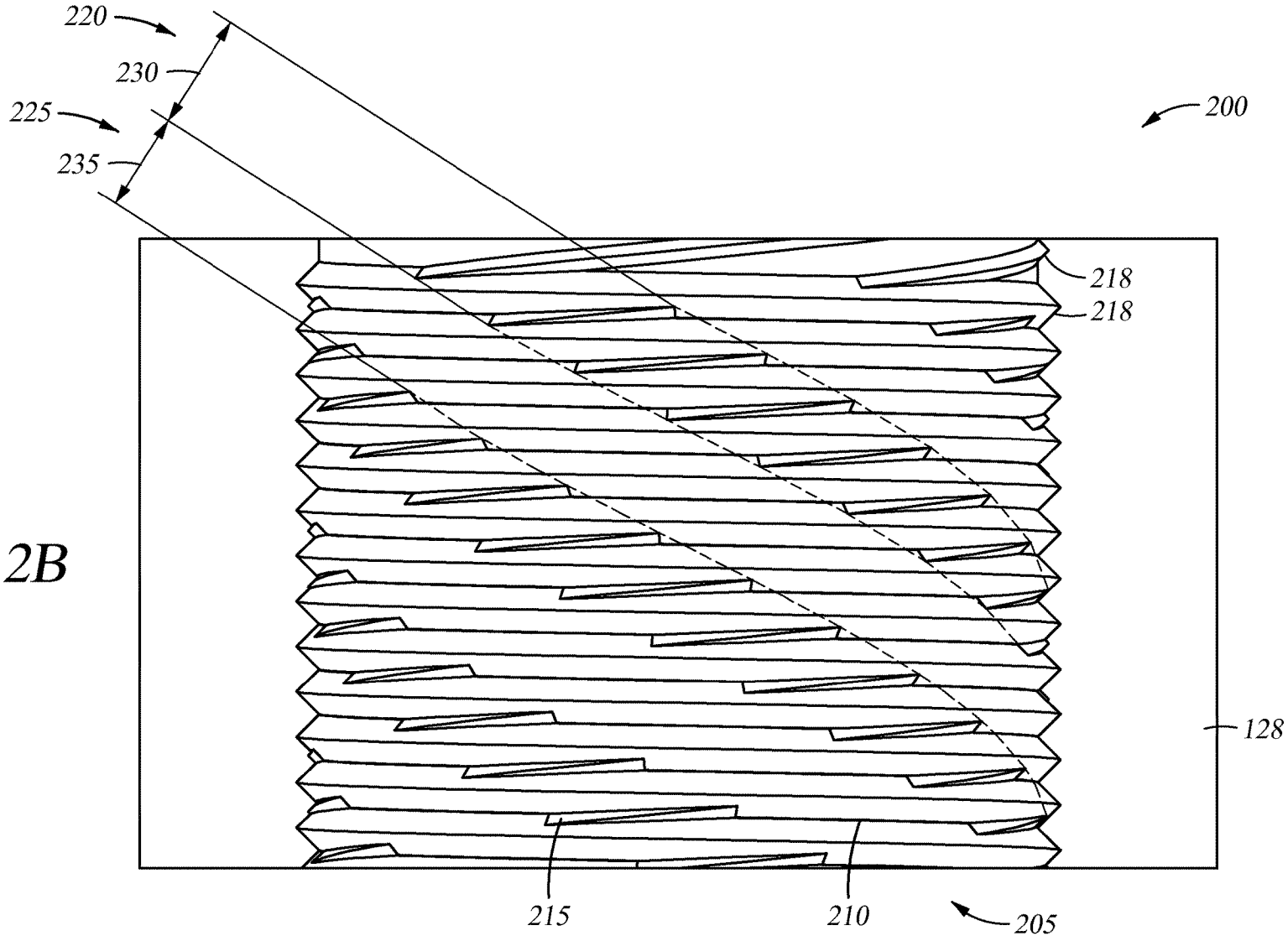
FIG. 2B is a front side view of the slip insert of FIG. 2A.

FIG. 2A is an isometric view of one embodiment of a slip insert 200 that may be used as the slip inserts 120 in the clamping device 100. FIG. 2B is a front side view of the slip insert 200 of FIG. 2A.

The slip insert 200 includes the face 125 having one embodiment of a profile 205 formed thereon. The profile 205 according to this embodiment includes a plurality of primary or first threads 210 interrupted by a plurality of secondary or second threads 215. The first thread 210 has a crest 218 which is interrupted by the second threads 215. At least a portion of the crests 218 contact the outer surface 150 of the tubular member 130 (shown in FIGS. 1A and 1B). Each of the first threads 210 may be right-handed threads and each of the second threads 215 may be left-handed threads, or vice versa. In one example, the first threads 210 may comprise an eight thread per inch ("TPI") cut (having a lead of about 0.125 inches) in a first direction (e.g., right-handed), and the second threads 215 may have a different TPI cut and may be cut in a second direction (e.g., left-handed). The first threads 210 and the second threads 215 may have any number of threads per inch and any number of thread starts. The second threads 215 interrupt the primary threads 210 to form the profile 205. The second threads 215 may be formed by multiple starts with a lead of differing dimensions. In one embodiment, the second threads 215 comprise a four start cut with a lead of 0.625 inch. With single start threads, such as the first thread 210, the thread pitch equals the thread lead. The lead of the second threads 215 (second lead) may be greater than the lead of the first threads 210 (first lead). In some embodiments, a percentage increase between the first lead of the first threads 210 and the second lead of the second threads 215 is about 400% based on the following exemplary equation:

((second lead (0.625")−first lead (0.125"))/first lead (0.125"))*100=400%

The profile 205 comprises of diagonal rows of non-mark areas 220 of the second threads 215 that interrupt the first threads 210. The remaining portion of the first threads 210 form the mark pattern 165 (shown in FIG. 1B) on the outer surface 150 of the tubular member 130. Thus, according to this embodiment, the profile 205 forms the mark pattern 165 having marks 180 (formed by the first thread 210) with interruptions of non-mark areas 220 that repeat in substantially diagonal rows (formed by the second threads 215) along the longitudinal axis 170 (shown in FIG. 1B) of the tubular member 130, thereby forming mark areas 225 in a helical pattern along the longitudinal axis 170 (shown in FIG. 1B) of the tubular member 130. The second threads 215 may include a length 230 and the mark areas 225 include a length 235. In some embodiments, the length 230 is substantially equal to, less than, or greater than the length 235.

Figure 3A:
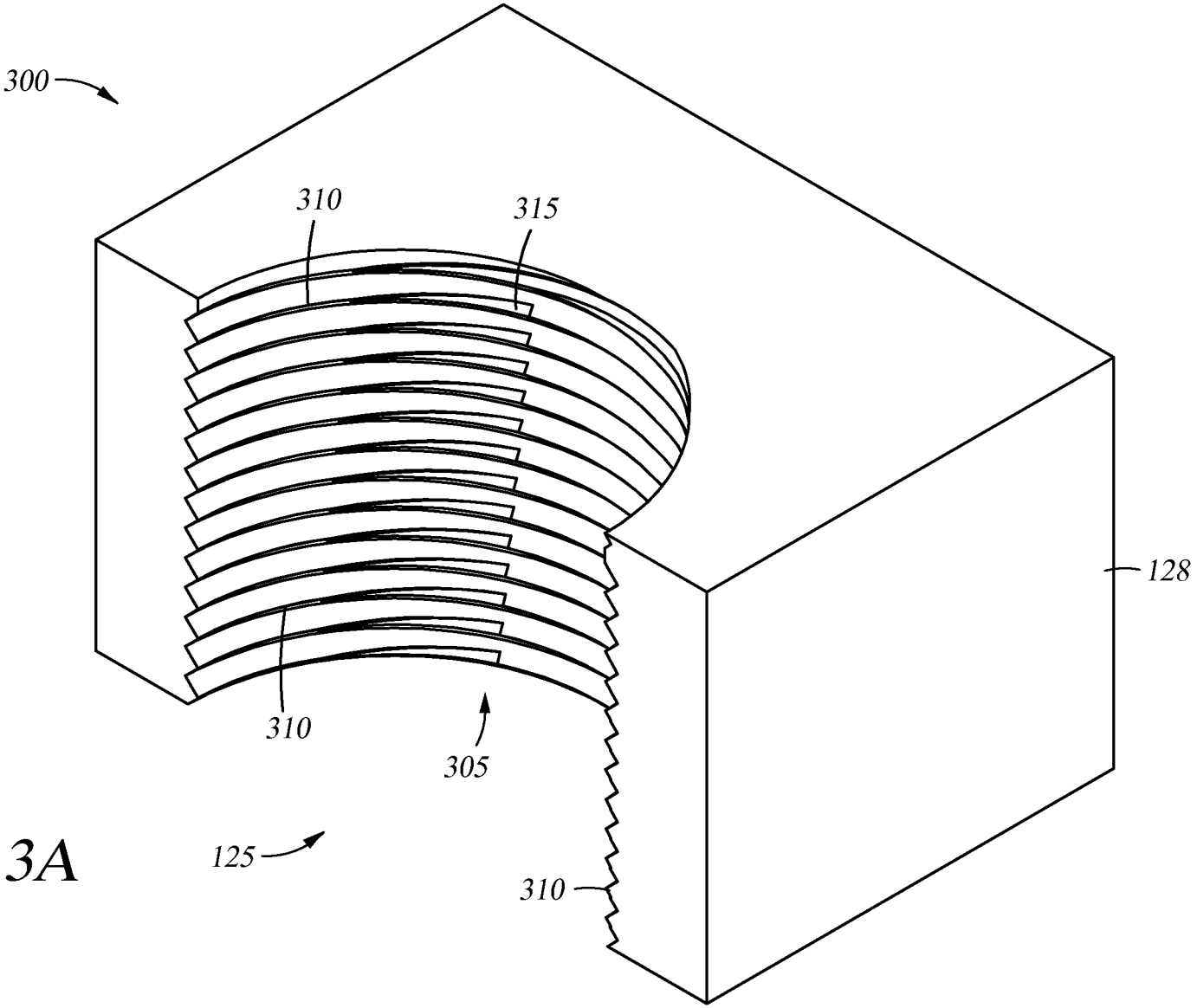
FIG. 3A is an isometric view of another embodiment of a slip insert that may be used as the slip inserts in the clamping device of FIGS. 1A and 1B.
Figure 3B:
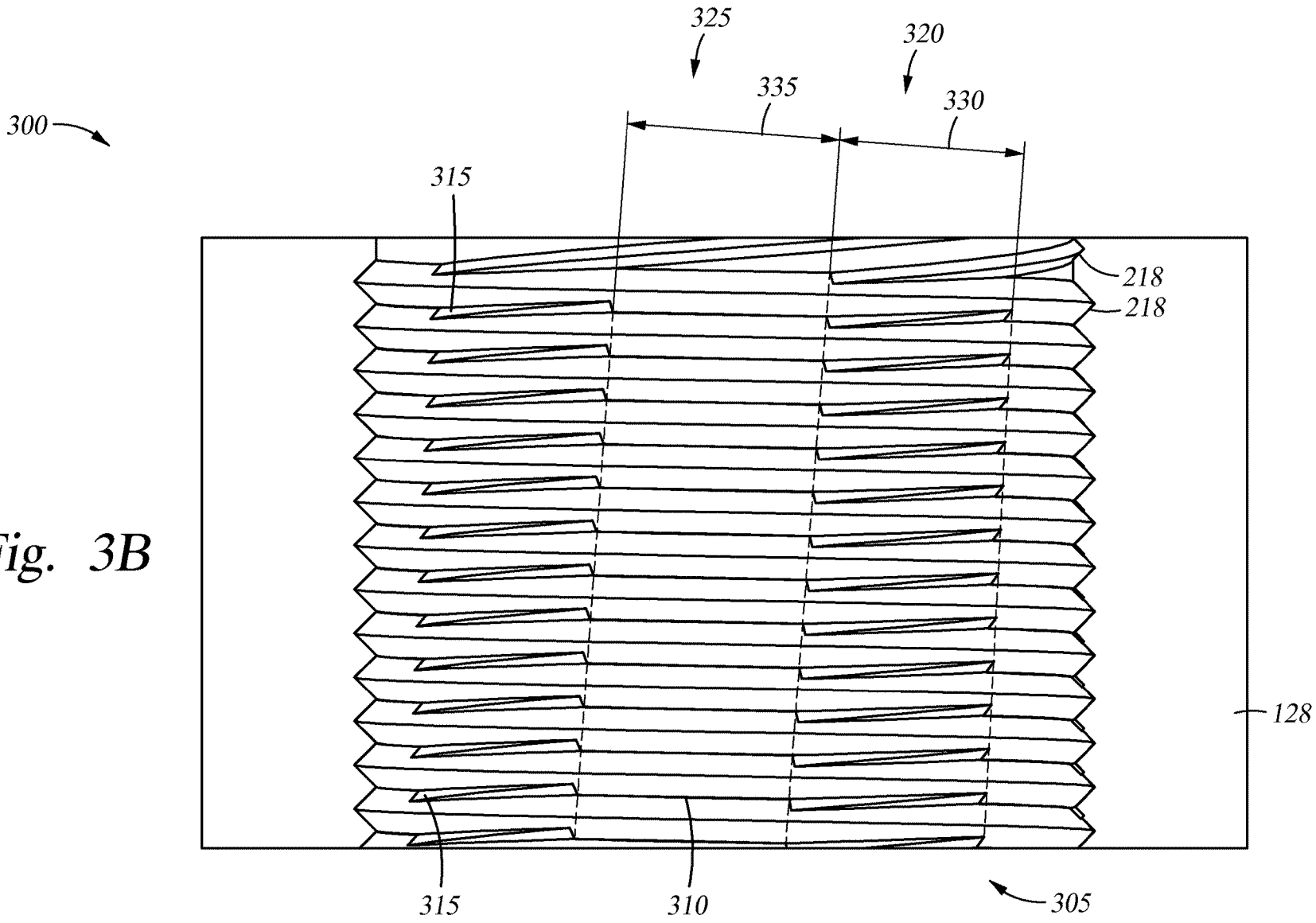
FIG. 3B is a front side view of the slip insert of FIG. 3A.

FIG. 3A is an isometric view of one embodiment of a slip insert 300 that may be used as the slip inserts 120 in the clamping device 100. FIG. 3B is a front side view of the slip insert 300 of FIG. 3A.

The slip insert 300 includes the face 125 having one embodiment of a profile 305 formed thereon. The profile 305 according to this embodiment includes a plurality of primary or first threads 310 interrupted by a plurality of secondary or second threads 315. The first thread 310 includes a crest 218 which is interrupted by the second thread 315. At least a portion of the crests 218 contact the outer surface 150 of the tubular member 130 (shown in FIGS. 1A and 1B). Each of the first threads 310 may be right-handed threads and each of the second threads 315 may be left-handed threads, or vice versa. In one example, the first threads 310 may comprise an eight TPI cut in a first direction (e.g., right-handed), and the second threads 315 may have a different TPI cut and may be cut in a second direction (e.g., left-handed). The first threads 310 and the second threads 315 may have any number of threads per inch. The second threads 315 interrupt the primary threads 310 to form the profile 305. The second threads 315 may be formed by multiple starts with a lead of differing dimensions. In one embodiment, the second threads 315 comprise a four start cut with a lead of 0.5 inch. The lead of the second threads 315 (second lead) may be greater than the lead of the first threads 310 (first lead). In some embodiments, a percentage increase between the first lead of the first threads 310 and the second lead of the second threads 315 is about 300%.

The profile 305 comprises of substantially linear rows of non-mark areas 320 of the second threads 315 that interrupt the first threads 310. The remaining portion of the first threads 310 form the mark pattern 165 (shown in FIG. 1B) on the outer surface 150 of the tubular member 130. Thus, according to this embodiment, the profile 305 forms the mark pattern 165 having marks 180 (formed by the first thread 310) with interruptions of the non-mark areas 320 that repeat in substantially vertical rows (formed by the second threads 315) along the longitudinal axis 170 (shown in FIG. 1B) of the tubular member 130 with the non-mark areas 320 between mark areas 325. The second threads 315 may include a length 330 and the rows of mark areas 325 include a length 335. In some embodiments, the length 330 is substantially equal to, less than, or greater than the length 335.

Figure 4A:
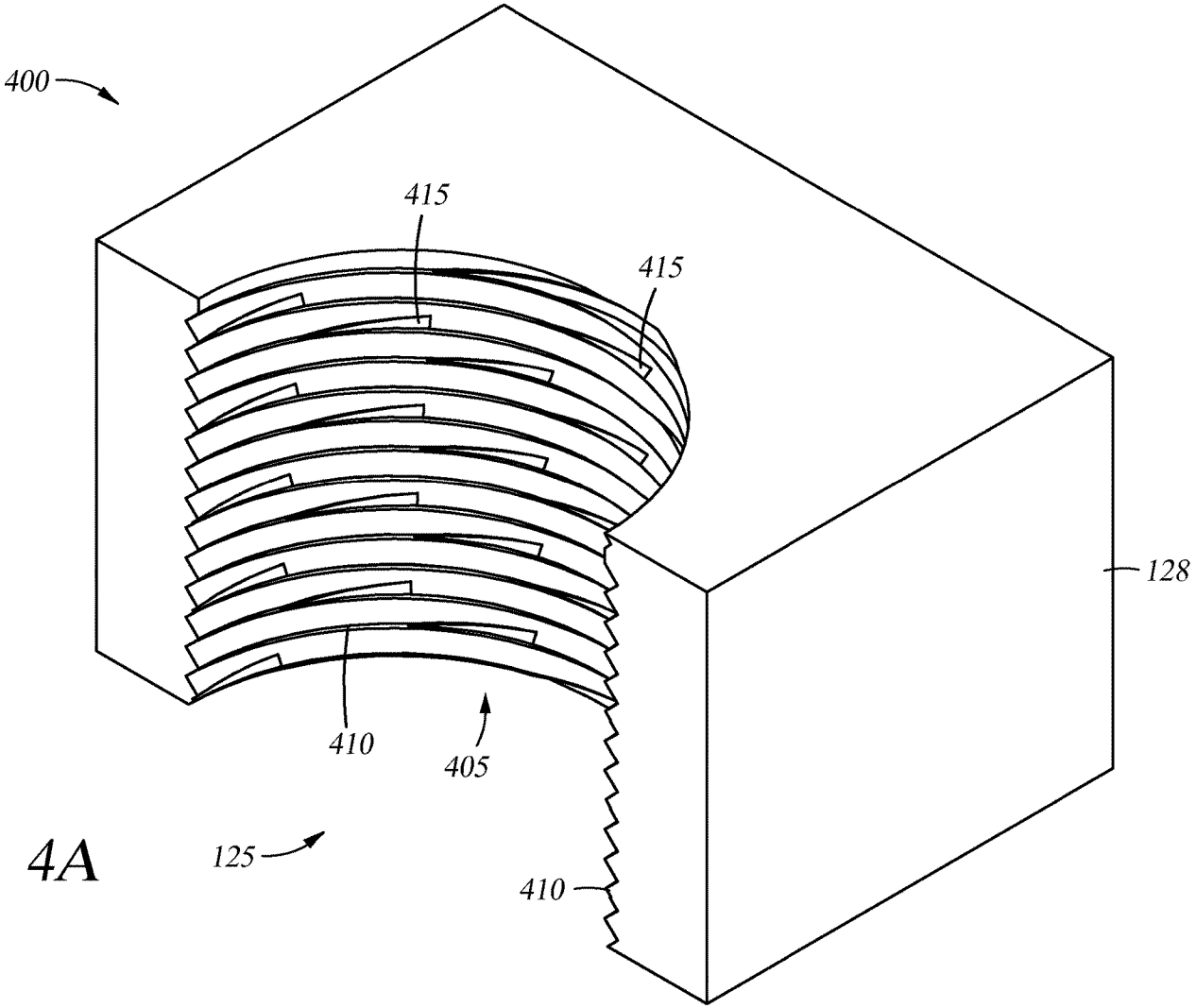
FIG. 4A is an isometric view of another embodiment of a slip insert that may be used as the slip inserts in the clamping device of FIGS. 1A and 1B.
Figure 4B:
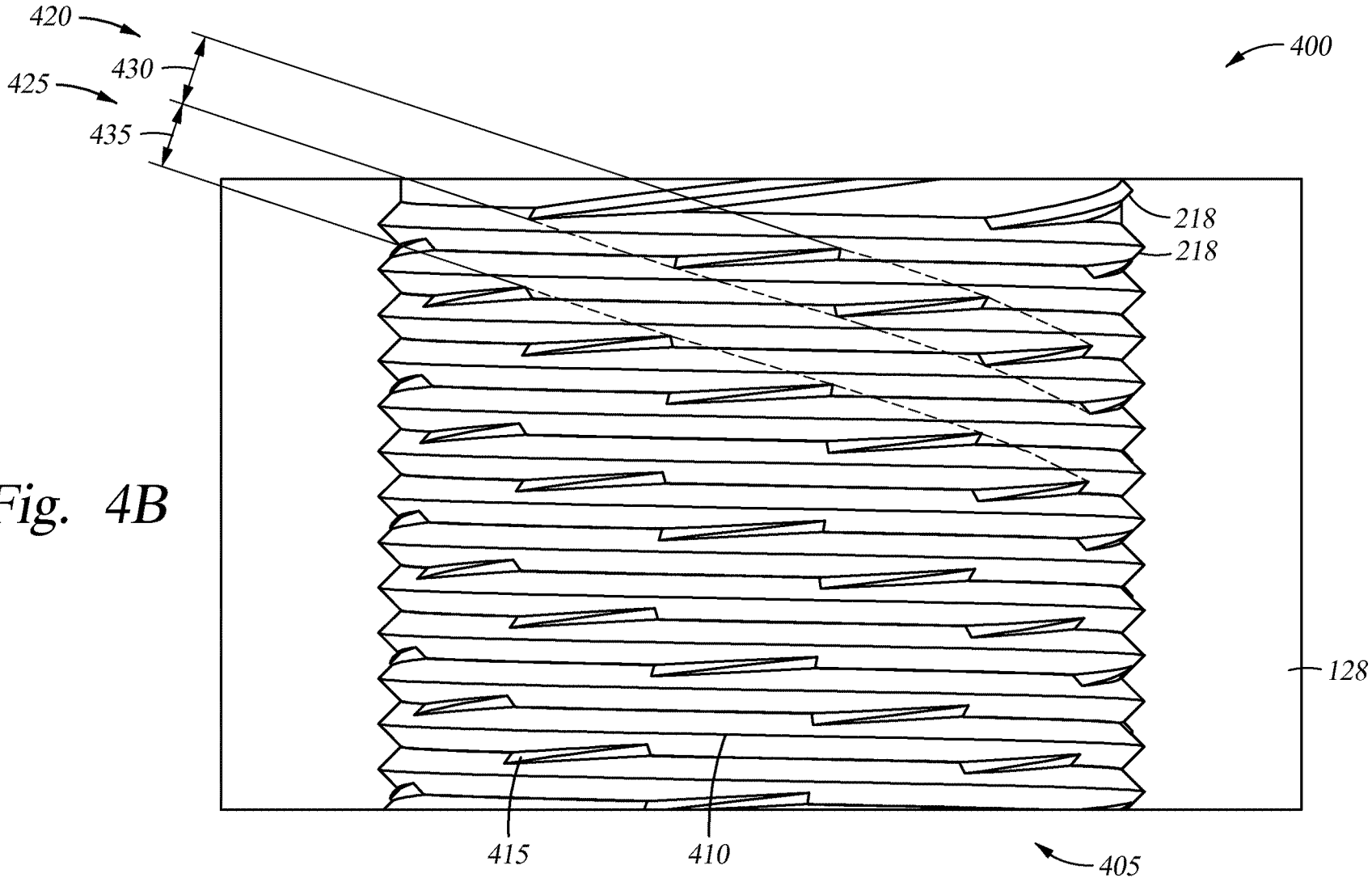
FIG. 4B is a front side view of the slip insert of FIG. 4A.

FIG. 4A is an isometric view of one embodiment of a slip insert 400 that may be used as the slip inserts 120 in the clamping device 100. FIG. 4B is a front side view of the slip insert 400 of FIG. 4A.

The slip insert 400 includes the face 125 having one embodiment of a profile 405 formed thereon. The profile 405 according to this embodiment includes a plurality of primary or first threads 410 interrupted by a plurality of secondary or second threads 415. Each of the first threads 410 may be right-handed threads and each of the second threads 415 may be left-handed threads, or vice versa. In one example, the first threads 410 may comprise an eight TPI cut in a first direction (e.g., right-handed), and the second threads 415 may have a different TPI cut and may be cut in a second direction (e.g., left-handed). The first threads 410 and the second threads 415 may have any number of threads per inch. The second threads 415 interrupt the primary threads 410 to form the profile 405. The second threads 415 may be formed by multiple starts with a lead of differing dimensions. In one embodiment, the second threads 415 comprise a four start cut with a lead of 0.75 inch. The lead of the second threads 415 (second lead) may be greater than the lead of the first threads 410 (first lead). In some embodiments, a percentage increase between the first lead of the first threads 410 and the second lead of the second threads 415 is about 500%.

The profile 405 comprises of diagonal rows of non-mark areas 420 of the second threads 415 that interrupt the first threads 410. The remaining portion of the first threads 410 form the mark pattern 165 (shown in FIG. 1B) on the outer surface 150 of the tubular member 130. Thus, according to this embodiment, the profile 405 forms the mark pattern 165 having marks 180 (formed by the first thread 410) with interruptions of the non-mark areas 420 that repeat in substantially diagonal rows (formed by the second threads 415) along the longitudinal axis 170 (shown in FIG. 1B) of the tubular member 130, thereby forming a helical mark pattern (defined by mark areas 425) along the longitudinal axis 170 (shown in FIG. 1B) of the tubular member 130. The second threads 415 may include a length 430 and the mark areas 425 include a length 435. In some embodiments, the length 430 is substantially equal to, less than, or greater than the length 435.

Embodiments of the slip inserts 120, 200, 300, and 400 as described herein comprise a face 125 with first threads interrupted by second threads. The profile of the slip inserts 120, 200, 300 and 400 form mark patterns on an outer surface 150 of a tubular member 130 that deconcentrates the marks as compared to conventional slip insert profiles. The ratio of lengths 230, 330, 430 of the non-mark areas 220, 320, 420 (i.e., lengths of the second threads) to lengths 235, 335, 435 of the mark areas 225, 325, 425 can be varied by the depth of the interrupted cut (i.e., depths of the second threads) through the first thread. In addition, the first thread profile may have zero lead (i.e., the first thread would have a horizontal profile as opposed to a helical profile). Utilization of the slip inserts 120, 200, 300 and 400 as described herein may increase the usable lifetime of tubular members, which reduces costs and may increase safety (due to premature failure).

While the foregoing is directed to embodiments of the present disclosure, other and further embodiments of the disclosure thus may be devised without departing from the basic scope thereof, and the scope thereof is determined by the claims that follow.

The invention claimed is:

1. A slip insert, comprising:

a body having a curved face for receiving a tubular member;

a plurality of first threads formed in a first direction on the face; and a plurality of second threads formed in a second direction on the face that interrupt the first threads, the second direction being opposite of the first direction, wherein the plurality of first threads and the plurality of second threads form a profile on the face having a non-marked area comprising a portion of the first threads that is separated by a marked area comprising a portion of both the first and second threads.

2. The slip insert of claim 1, wherein the non-marked area and marked area form rows across the face.

3. The slip insert of claim 2, wherein the rows are diagonally oriented across the face.

4. The slip insert of claim 2, wherein the rows are linearly oriented across the face.

5. The slip insert of claim 1, wherein the profile comprises at least two rows of marked areas separated by the non-marked area.

6. The slip insert of claim 1, wherein a percentage increase in a lead of the first threads and a lead of the second threads is about 500%.

7. The slip insert of claim 1, wherein a percentage increase in a lead of the first threads and a lead of the second threads is about 400%.

8. The slip insert of claim 1, wherein a percentage increase in a lead of the first threads and a lead of the second threads is about 300%.

9. A slip insert, comprising:

a body having a curved face for receiving a tubular member;

a plurality of first threads formed in a first direction on the face and having a first lead; and a plurality of second threads formed in a second direction on the face that interrupt the first threads and having a second lead, the second direction being opposite of the first direction, and the second lead being greater than the first lead, wherein the plurality of first threads and the plurality of second threads form a profile on the face having a non-marked area comprising a portion of the first threads that is separated by a marked area comprising a portion of both the first and second threads.

10. The slip insert of claim 9, wherein the non-marked area and marked area form rows across the face.

11. The slip insert of claim 10, wherein the rows are diagonally oriented across the face.

12. The slip insert of claim 10, wherein the rows are linearly oriented across the face.

13. The slip insert of claim 9, wherein the profile comprises at least two rows of marked areas separated by the non-marked area.

14. A clamping device, comprising:

a housing; and a first slip insert disposed in the housing and a second slip insert disposed in the housing opposing the first slip insert, wherein each of the slip inserts comprise:

a body having a curved face for receiving a tubular member;

a plurality of first threads formed in a first direction on the face; and a plurality of second threads formed in a second direction on the face that interrupt the first threads, the second direction being opposite of the first direction, wherein the plurality of first threads and the plurality of second threads form a profile on the face having a non-marked area comprising a portion of the first threads that is separated by a marked area comprising a portion of both the first and second threads.

15. The clamping device of claim 14, wherein the first threads comprise a first lead and the second threads comprise a second lead that is greater than the first lead.

16. The clamping device of claim 14, wherein the non-marked area and marked area form rows across the face.

17. The clamping device of claim 16, wherein the rows are diagonally oriented across the face.

18. The clamping device of claim 16, wherein the rows are linearly oriented across the face.

19. The clamping device of claim 14, wherein the profile comprises at least two rows of marked areas separated by the non-marked area.

* * * * *